United States Patent [19]

Gebarowski et al.

[11] 4,292,504

[45] Sep. 29, 1981

[54] EXPANDED METAL ELECTRIC HEATING ELEMENT WITH EDGE SUPPORT

[75] Inventors: Peter D. Gebarowski, Cookeville, Tenn.; Sam W. Henry, North Ogden, Utah

[73] Assignee: Tutco, Inc., Cookeville, Tenn.

[21] Appl. No.: 81,256

[22] Filed: Oct. 2, 1979

[51] Int. Cl.[3] ..... H05B 3/06

[52] U.S. Cl. ..... 219/542; 219/459; 219/536; 219/541; 219/548; 219/552; 338/280; 338/285

[58] Field of Search ..... 219/265, 390, 452, 459, 219/460, 462, 463, 464, 467, 532, 541, 542, 544, 538, 536, 552, 553, 548; 338/279, 280, 282, 281, 285, 287, 303, 293, 304, 505, 318, 319; 13/25, 22; 29/611

[56] References Cited

U.S. PATENT DOCUMENTS

| | | | |
|---|---|---|---|
| 560,588 | 5/1896 | Leonard | 338/280 |
| 1,673,225 | 6/1928 | Bunge | 219/460 |
| 3,086,101 | 4/1963 | Scofield | 219/460 |
| 3,271,560 | 9/1966 | Schott, Jr. | 219/542 X |
| 3,381,109 | 4/1968 | Youhouse | 219/265 |
| 3,636,309 | 1/1972 | Deaton et al. | 219/452 |
| 3,749,883 | 7/1973 | Vodvarka et al. | 219/463 |
| 3,833,793 | 9/1974 | McWilliams et al. | 219/464 |
| 3,952,408 | 4/1976 | Docx | 29/611 |
| 3,984,615 | 10/1976 | Beck | 219/552 |
| 3,991,298 | 11/1976 | Maake | 219/464 |
| 4,034,206 | 7/1977 | Peurod | 219/464 |
| 4,161,648 | 7/1979 | Göessler | 219/464 |

FOREIGN PATENT DOCUMENTS

| | | | |
|---|---|---|---|
| 711350 | 6/1965 | Canada | 219/460 |

*Primary Examiner*—Volodymyr Y. Mayewsky
*Attorney, Agent, or Firm*—Berman, Aisenberg & Platt

[57] ABSTRACT

An electric resistance heating unit in which the heating element is a thin, foil-like strip of expanded metal supported on edge substantially along its entire length on a board of insulating material. The heating element is formed in a serpentine pattern, and its bottom edge is embedded in a similar serpentine groove in the upper surface of a ceramic fiberboard and cemented therein.

11 Claims, 7 Drawing Figures

EXPANDED METAL ELECTRIC HEATING ELEMENT WITH EDGE SUPPORT

BACKGROUND OF THE INVENTION

1. Field of the Invention

The invention relates to an electric resistance heating unit, and more particularly, to a heating unit having an expanded metal, foil-like strip, as the resistance element, supported on edge along its entire length on an insulating supporting board.

2. Description of the Prior Art

The prior use of a very thin, foil-like resistance heating element, formed of expanded metal and arranged in a grid of a series of parallel corrugations mounted skewer-like on an insulated rod passing through the corrugations, is described in U.S. Pat. No. 3,651,304 granted to Robert J. Fedor on Mar. 21, 1972. Maake, U.S. Pat. No. 3,798,419, is also of interest. The patented Fedor unit offers the advantages of a heating element having high surface area and low mass with attendant savings in raw material, improved heating efficiency, and prevention of sagging which would result in failure of the element.

It has been found that the patented construction involves considerable high cost, hand labor during assembly, permits variation of the spacing between corrugations on the skewer-like support rod under high temperature expansion, yields danger of overheating and even shorting of the strip element, and that the use of support rods limits the flexibility of configurations possible for the heating element.

Various improvements in the above-described patented device are known. Mainly, these involve stringing the expanded metal elements around spaced and fixed ceramic insulators, or passing one edge of the expended-metal strip loosely through grooves in spaced insulators while still retaining the corrugated wavy pattern of the heating element. These improvements still evidence certain disadvantages. For example, manual assembly is required and during assembly a worker must preliminarily string the heating element with the correct mechanical tension to compensate for later thermal expansion so as to prevent sagging at operating temperatures. This requires a high degree of skill and judgment. Also, the ceramic insulators used in conjunction with the heating element must be manually loaded in a metal base, or support frame. Further, a number of desirable patterns or configurations of the heating element are unobtainable, so that the flexibility of patterns in use is restricted.

SUMMARY OF THE INVENTION

The above briefly described disadvantages of the prior art devices are overcome in the present invention by providing a heating element, formed as a thin strip of expanded metal shaped in a serpentine pattern and supported on edge along virtually its entire length by embedding the lower edges in a similar serpentine groove on the upper surface of an insulating support board. This adequately supports the heating element under all operating conditions, prevents sagging, and provides a rugged reliable heating unit, capable of automated assembly in a wide variety of configurations.

It is, therefore, a primary object of the present invention to provide an electric heating unit which overcomes the disadvantages common in the prior art.

It is another main object of the invention to provide a thin foil-like strip of resistance material as the heating element, which is supported on edge along substantially its entire length so as to prevent sagging at operating temperatures, and thus increase reliability.

Yet another important object of the invention is to provide an improved heating unit which may be assembled by automatic machinery, reducing the high degree of manual, skilled labor required in assembling conventional devices.

Still another object of the invention is to provide an improved heating unit, having the above-described characteristics, which lends itself to a very wide variety of heating element configurations, and which is usable in both radiant and moving moist air applications.

Yet a further object of the invention is to provide an improved heating unit having the above-described characteristics, which is simple and economical to make and rugged, reliable and efficient in use.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of specific embodiments, when read in connection with the accompanying drawings, wherein like reference characters indicate like parts throughout the several Figures, and in which:

DESCRIPTION OF THE PREFERRED EMBODIMENTS

Figure 1:
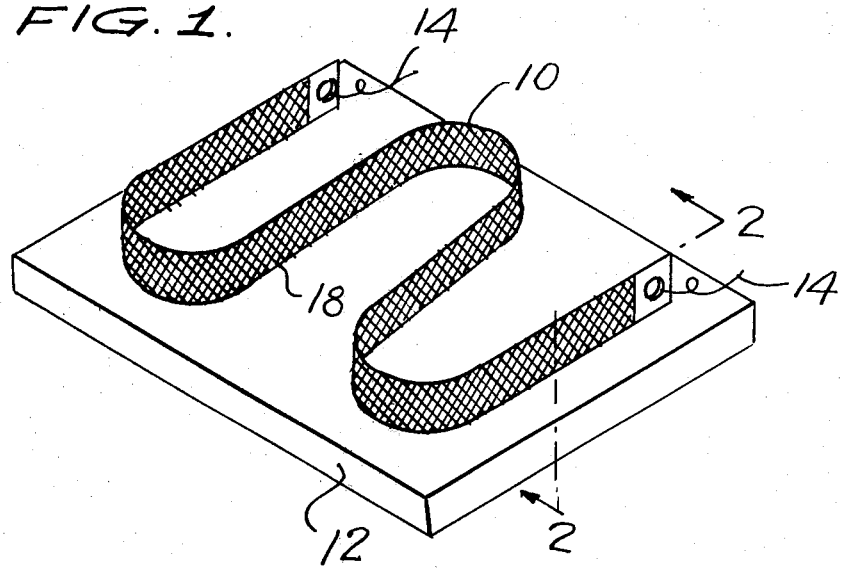
FIG. 1 is a perspective view of an improved heating unit according to the invention in simplified form.
Figure 2:
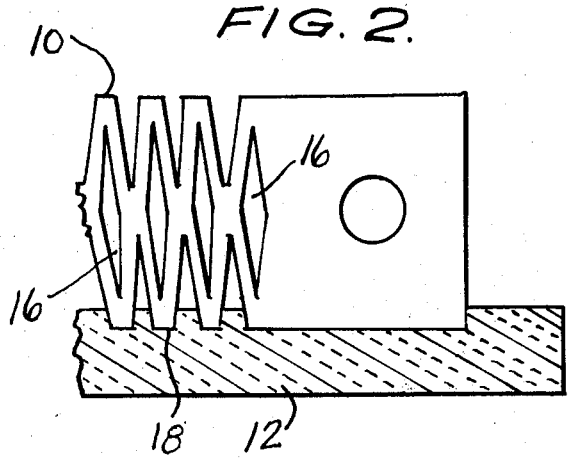
FIG. 2 is a sectional view of the unit taken along line 2—2 of FIG. 1 and looking in the direction of the arrows.
Figure 4:
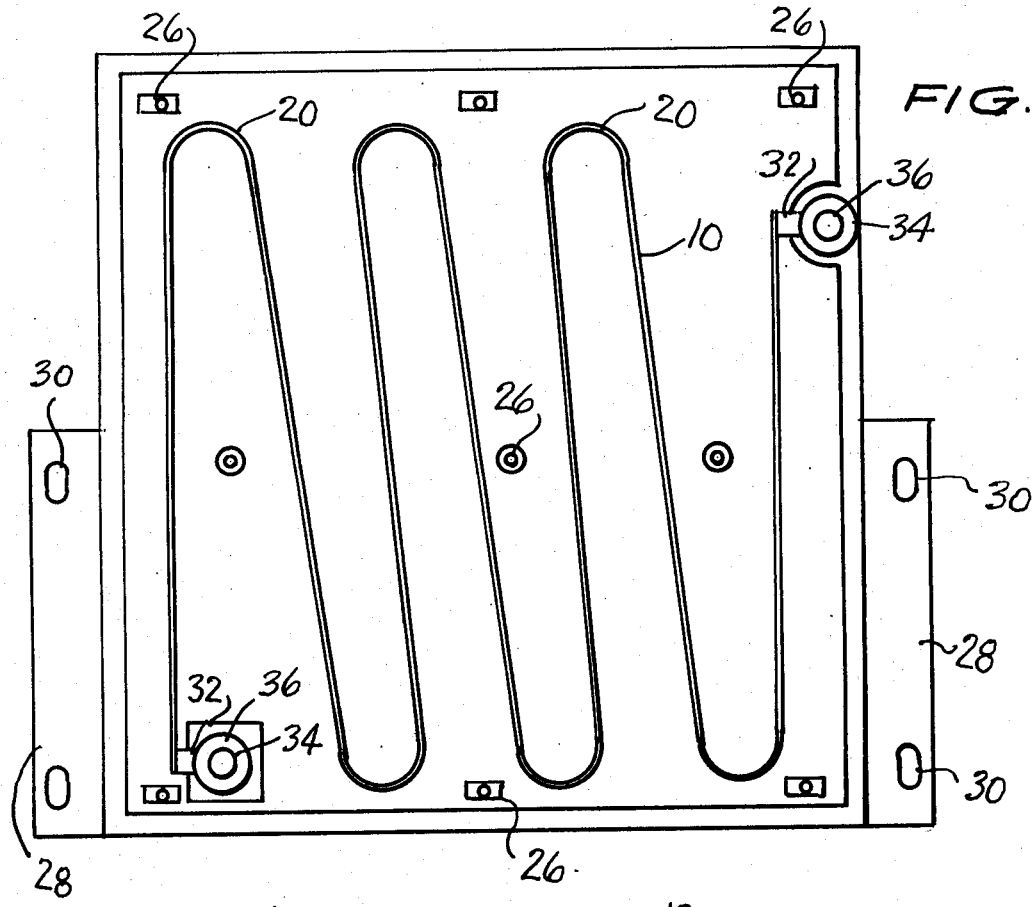
FIG. 4 is a plan view of a complete heating unit forming the preferred embodiment of the invention, and suitable for both radiant and moist air moving applications.
Figure 5:
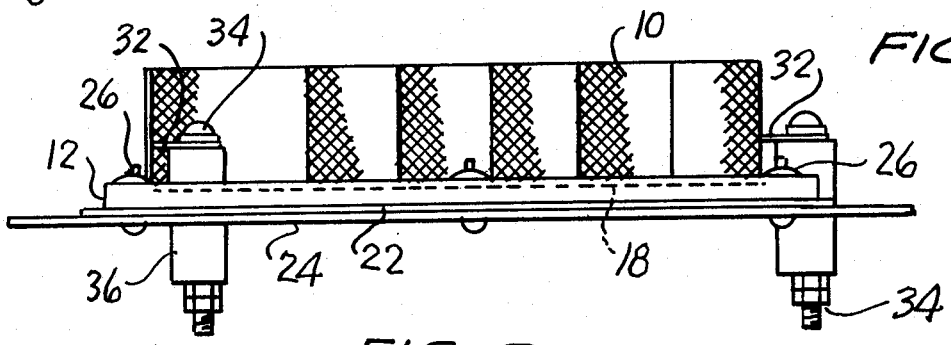
FIG. 5 is an elevational view of the unit of FIG. 4.
Figure 6:
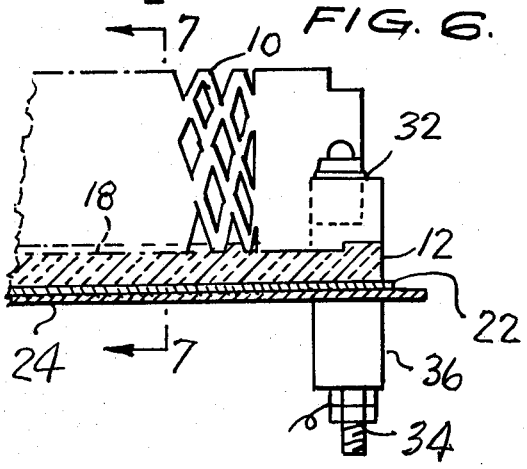
FIG. 6 is an enlarged, fragmentary, elevational view of a terminal portion of the unit of FIG. 5.
Figure 7:
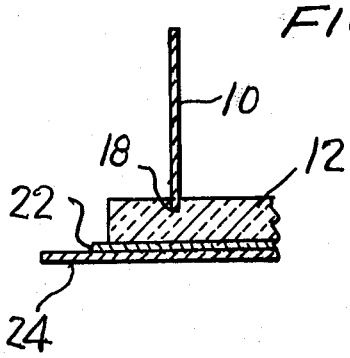
FIG. 7 is a sectional view taken along line 7—7 of FIG. 6 and looking in the direction of the arrows.

Referring now to the drawings, FIGS. 1 and 2 illustrate the concept of the invention in its simplest form as including a thin foil strip 10 of electric resistance material supported on edge continuously along its entire length by an insulating mounting plate 12. The terminal ends of strip 10 are connected to a power source at terminals 14.

Figure 3:
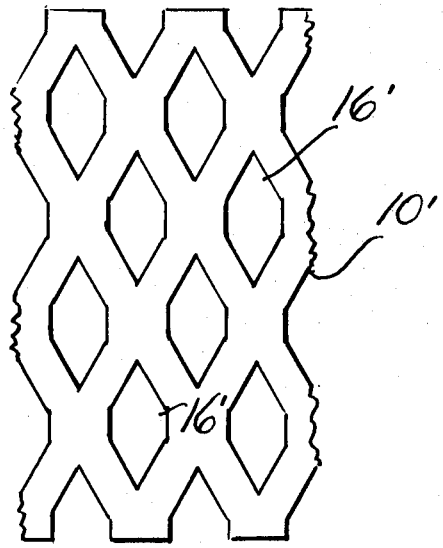
FIG. 3 is an elevational view of a fragment of a modified, expanded metal heating element usable in the unit.

In order to obtain the advantage of high surface area and low mass, the heating element 10 is preferably an apertured, foil-like strip of iron, chromium, aluminium alloy. Other possible alloys are nickel and chromium alloys such as any of those elements fully described in U.S. Pat. No. 3,651,304 mentioned above. In addition, other nickel base alloys, stainless steel or aluminum foil might be utilized. Basically, the only criterion for the composition of the heating element is that it be formed of an alloy or metal suitable when heated to produce a sufficient amount of heat. The strip varies in thickness between 4 to 16 mils and is desirably of expanded metal construction having diamond shaped apertures 16, as more clearly shown in FIG. 2. The apertures allow passage of air, as well as permit lateral expansion of the heating element. Any suitable configuration of aperatures may be used such as square or rectangular. In FIG. 3 a heating element 10' is illustrated as having hexagonal apertures 16'.

The strip 10 is formed in a serpentine pattern having substantially equal spaces between the waves or corrugations of the pattern. In order to support the strip and prevent alterations of the wave spacing during high temperature operation of the heating element, the entire bottom edge of the strip 10 is seated in a groove 18 having the desired serpentine pattern. The width of the groove closely fits the strip width so that the strip is embedded with force and firmly held by friction. Other means of securement may be used with or without groove 18, and added securement may be gained by supplementary use of cement, or the like. In any case, the entire bottom edge of the strip is securely supported permitting upward and lateral expansion of the upper portion of the strip to a degree during operation, but without any substantial alteration of the spacing between curved portions of the strip as is possible with conventional heating units, in which the sagging of the element frequently results in failure of the unit.

The mounting board, or plate 12, may be formed of any suitable insulating material such as ceramic fiber board. It should then be apparent that both the mounting board and the heating element may be automatically formed and assembled by machinery and that the need for hand labor to pretension the element and to properly position and tension the element in its serpentine pattern are both eliminated.

A preferred embodiment of the heating unit, suitable for use in enclosed radiant applications such as ovens, glass-top heating assemblies or microwave oven browning units, as well as moving moist air applications, such as electric furnaces, clothes dryers or heat pumps, is illustrated in FIGS. 4–7. This heating unit utilizes a longer, foil, heating strip 10 arranged in a serpentine pattern having three parallel corrugations or waves 20 and embedded on edge in a groove 18 of ceramic fiber board 12, as in FIG. 1. The element is retained permanently by use of a ceramic cement, or fused silica cement, not shown, which is distributed either continuously or semi-continuously along the element-fiber board interface, or impregnated in the entire fiber board body. Beneath the fiber board 12, is placed a layer 22 of material having high dielectric strength such as mica. A supporting fixture in the form of a flat metal plate 24 underlies the insulating layer 22. The mounting board 12, insulating layer 22 and support plate 24 are securely held together by a plurality of rivet-like fasteners 26, which pass through them. Support fixture 24 at opposite sides has a pair of protruding wings 28,28 with bolt receiving slots 30,30 for mounting the unit in an oven or furnace. The heating element at its ends 32,32 is connected to terminals 34,34 which are surrounded by passing insulators 36,36 which pass through aligned openings in the fiber board 12, insulating layer 22 and support fixture 24 (if necessary).

It should be apparent that the above-described heating unit may be easily and automatically fabricated and assembled without hand labor, and provides a highly efficient device in which the heating element is fully supported along its entire length and is thus prevented from sagging during operation to an extent that would cause failure.

Although certain specific embodiments of the invention have been shown and described, it is obvious that many modifications thereof are possible. The invention, therefore, is not intended to be restricted to the exact showing of the drawings and descriptions thereof, but is considered to include reasonable and obvious equivalents.

What is claimed is:

1. An electric resistance heating unit, comprising: a support board of ceramic fiber insulating material having a continuous groove on the surface, a thin apertured expanded strip of foil-like electric resistance material wherein said strip has one of its edges embedded in said groove and is substantially perpendicular to the surface of said support board, means supporting said strip of foil-like material on edge along substantially its entire length on said support board comprising: cement distributed at least semi-continuously along said strip to fasten the edge of the strip in the support board, and terminals conductively connected to said thin strip of foil-like electric resistance material, said terminals being insulatedly passed through said support board.

2. An electric resistance heating unit according to claim 1, wherein said ceramic fiber support board has fastened to its under-surface a sheet of dielectric insulating material, and said sheet of dielectric insulating material is fastened to an underlying metal support plate.

3. An electric heating unit according to claim 2, wherein the ends of said foil-like strip are connected to a pair of said terminals, and said terminals are insulatedly passed through said ceramic fiber board, sheet of dielectric insulating material and underlying metal supporting plate.

4. An electric resistance heating unit comprising:

a support board of substantially inflexible ceramic insulating material;

a relatively thin groove formed in the upper surface of said board in a curvilinear pattern, said groove having a bottom wall and side walls;

a thin strip of foil-like electric resistance material embedded in said groove and having the majority of its surface area extending upwardly away from said groove and perpendicularly to said board, the portions of said resistance material within said groove being in direct contact with the bottom wall and both side walls of said groove, the width of the groove closely fitting the strip width so that the strip is embedded with force and firmly held by friction; and terminal means supported on said board and electrically connected to said strip.

5. The electric resistance heating unit according to claim 4 further including cement distributed at least semicontinuously along said strip to aid in retaining said strip on said board.

6. The electric resistance heating unit according to claim 5 wherein said cement is a fused silica cement.

7. The electric resistance heating unit according to claim 5 wherein said cement is a ceramic cement.

8. The electric resistance heating element according to claim 4 wherein said resistance material is arranged in a serpentine pattern.

9. The electric resistance heating element according to claim 8 wherein said serpentine pattern has substantially equal spaces between its waves.

10. The electric resistance heating element according to claim 4 wherein said resistance material is of expanded metal construction having apertures therein.

11. The electric resistance heating element according to claim 4 wherein said support board is formed of ceramic fiber.

* * * * *